US010829324B2

(12) United States Patent
Iino

(10) Patent No.: US 10,829,324 B2
(45) Date of Patent: Nov. 10, 2020

(54) SHEET CONVEYING DEVICE, IMAGE PROCESSING APPARATUS, IMAGE FORMING APPARATUS, AND SHEET CONVEYING METHOD

(71) Applicant: TOSHIBA TEC KABUSHIKI KAISHA, Tokyo (JP)

(72) Inventor: Seiji Iino, Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 25 days.

(21) Appl. No.: 16/266,202

(22) Filed: Feb. 4, 2019

(65) Prior Publication Data

US 2020/0247629 A1 Aug. 6, 2020

(51) Int. Cl.

| | |
|---|---|
| ***B65H 5/06*** | (2006.01) |
| ***B65H 7/20*** | (2006.01) |
| ***B65H 7/02*** | (2006.01) |
| ***B65H 9/14*** | (2006.01) |

(52) U.S. Cl.

CPC ..... *B65H 5/062* (2013.01); *B65H 7/02* (2013.01); *B65H 7/20* (2013.01); *B65H 9/14* (2013.01); *B65H 2515/704* (2013.01); *B65H 2553/45* (2013.01)

(58) Field of Classification Search

CPC ..... B65H 5/062; B65H 2515/704

See application file for complete search history.

(56) References Cited

U.S. PATENT DOCUMENTS

| | | | | |
|---|---|---|---|---|
| 8,474,815 | B2 | 7/2013 | Takahashi | |
| 9,857,750 | B1 * | 1/2018 | Moriya | G03G 15/6567 |
| 10,162,296 | B2 * | 12/2018 | Moriya | G03G 15/5054 |
| 10,252,872 | B2 * | 4/2019 | Nishizawa | B65H 3/0669 |
| 10,305,406 | B2 * | 5/2019 | Sato | H02P 21/20 |

* cited by examiner

*Primary Examiner* — Patrick Cicchino

(74) *Attorney, Agent, or Firm* — Amin, Turocy & Watson, LLP

(57) ABSTRACT

According to one embodiment, a sheet conveying device includes a conveying roller, a motor, a resist roller, a sensor, and a motor control unit. The conveying roller conveys a sheet. The motor rotates the conveying roller. The resist roller corrects an inclination of the sheet conveyed by the conveying roller. The sensor is positioned upstream of the resist roller and detects the sheet. The motor control unit determines that the sheet abuts on the resist roller after the sheet is detected by the sensor and rotates the motor by a predetermined number of rotations after it is determined that the sheet abuts on the resist roller.

18 Claims, 9 Drawing Sheets

SHEET CONVEYING DEVICE, IMAGE PROCESSING APPARATUS, IMAGE FORMING APPARATUS, AND SHEET CONVEYING METHOD

FIELD

Embodiments described herein relate generally to a sheet conveying device, an image processing apparatus, an image forming apparatus, and a sheet conveying method.

BACKGROUND

Image forming apparatuses such as multi-function peripherals (MFPs) generally include auto document feeders (ADFs). The ADF conveys a sheet by a feed roller and reads the sheet as image data. The ADF includes a resist roller abutting on the leading end of the sheet and a resist sensor provided upstream of the resist roller in order to correct an inclination of the sheet. The ADF rotates the feed roller by a predetermined number of rotations after the sheet is detected by the resist sensor. The sheet is conveyed by a distance corresponding to the predetermined number of rotations of the feed roller. As a result of the conveyance, the leading end of the sheet abuts on the resist roller and is further conveyed thereafter. For this reason, the ADF may form a deflection in the sheet.

However, a frictional force between the sheet and the feed roller varies depending on a change in humidity around the ADF and the type of sheet. A conveyance distance of the sheet varies depending on a condition such as a frictional force even when the number of rotations of the feed roller is the same. For this reason, the magnitude of a deflection of the sheet may vary depending on a change in a condition such as a frictional force.

DETAILED DESCRIPTION

Exemplary embodiments provide a sheet conveying device, an image processing apparatus, an image forming apparatus, and a sheet conveying method which are capable of reducing variations in the magnitude of a deflection of a sheet.

In general, according to one embodiment, a sheet conveying device includes a conveying roller, a motor, a resist roller, a sensor, and a motor control unit. The conveying roller conveys a sheet. The motor rotates the conveying roller. The resist roller corrects an inclination of the sheet conveyed by the conveying roller. The sensor is positioned upstream of the resist roller and detects the sheet. The motor control unit determines that the sheet abuts on the resist roller after the sheet is detected by the sensor, and rotates the motor by a predetermined number of rotations after it is determined that the sheet abuts on the resist roller.

Hereinafter, a sheet conveying device, an image processing apparatus, an image forming apparatus, and a sheet conveying method according to the embodiment will be described with reference to the accompanying drawings.

Figure 1:
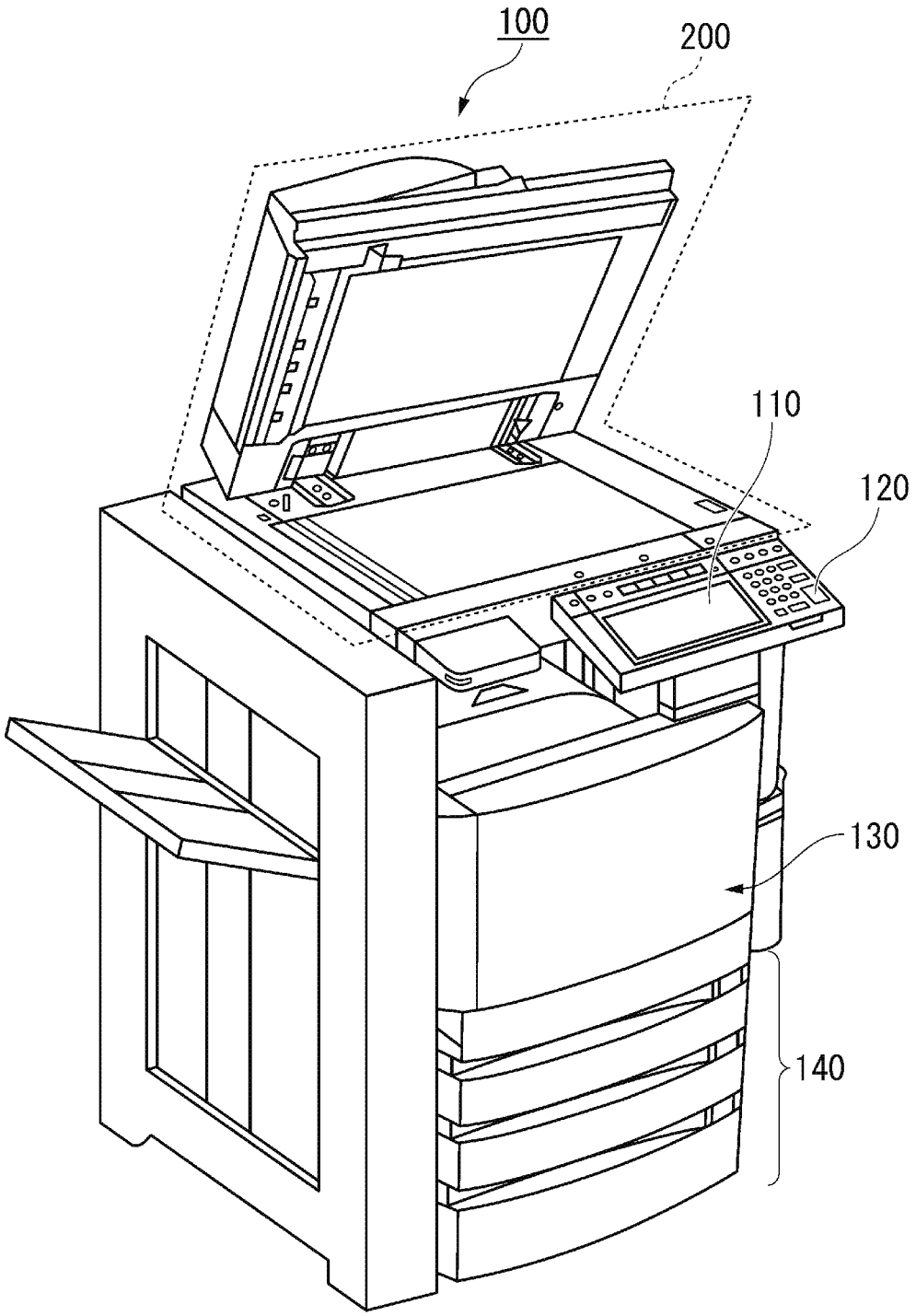
FIG. 1 is an external view showing an example of the overall configuration of an image processing apparatus according to an embodiment.

FIG. 1 is an external view showing an example of the overall configuration of an image processing apparatus 100 according to the embodiment. The image processing apparatus 100 is an image forming apparatus such as a multi-functional peripheral. The image processing apparatus 100 includes a display 110, a control panel 120, a printer 130, a sheet storage unit 140, and an image reading unit 200. Meanwhile, the printer 130 of the image processing apparatus 100 may be a device for fixing a toner image or may be an inkjet-type device.

The image processing apparatus 100 reads an image displayed on a sheet to generate digital data and generates an image file. The sheet is, for example, an original document, paper on which characters, images, and the like are printed, or the like. The sheet may be anything as long as the sheet can be read by the image processing apparatus 100.

The display 110 is an image display device such as a liquid crystal display and an organic electroluminescence (EL) display. The display 110 displays various types of information on the image processing apparatus 100.

The control panel 120 includes a plurality of buttons. The control panel 120 receives a user's operation. The control panel 120 outputs a signal corresponding to an operation performed by the user to a control unit 170 of the image processing apparatus 100. Meanwhile, the display 110 and the control panel 120 may be configured as an integral touch panel.

The printer 130 forms an image on a sheet on the basis of image information generated by the image reading unit 200 or image information received through a communication path. The printer 130 forms an image by, for example, the following processing. An image forming section of the printer 130 forms an electrostatic latent image on a photoconductive drum on the basis of image information. The image forming section of the printer 130 forms a visible image by attaching a developer to the electrostatic latent image. A specific example of the developer is a toner. A transfer section of the printer 130 transfers a visible image on a sheet. A fixing section of the printer 130 fixes the visible image on the sheet by applying heat and pressure to the sheet. Meanwhile, a sheet having an image formed thereon may be a sheet stored in the sheet storage unit 140 or may be a manually inserted sheet.

The sheet storage unit 140 stores a sheet used for image formation in the printer 130.

The image reading unit 200 reads image information to be read as brightness and darkness of light. The image reading unit 200 records the read image information. The read image information may be transmitted to another information processing device via a network. The recorded image information may be formed into an image on a sheet by the printer 130. A configuration of the image reading unit 200 will be described using FIG. 2.

Figure 2:
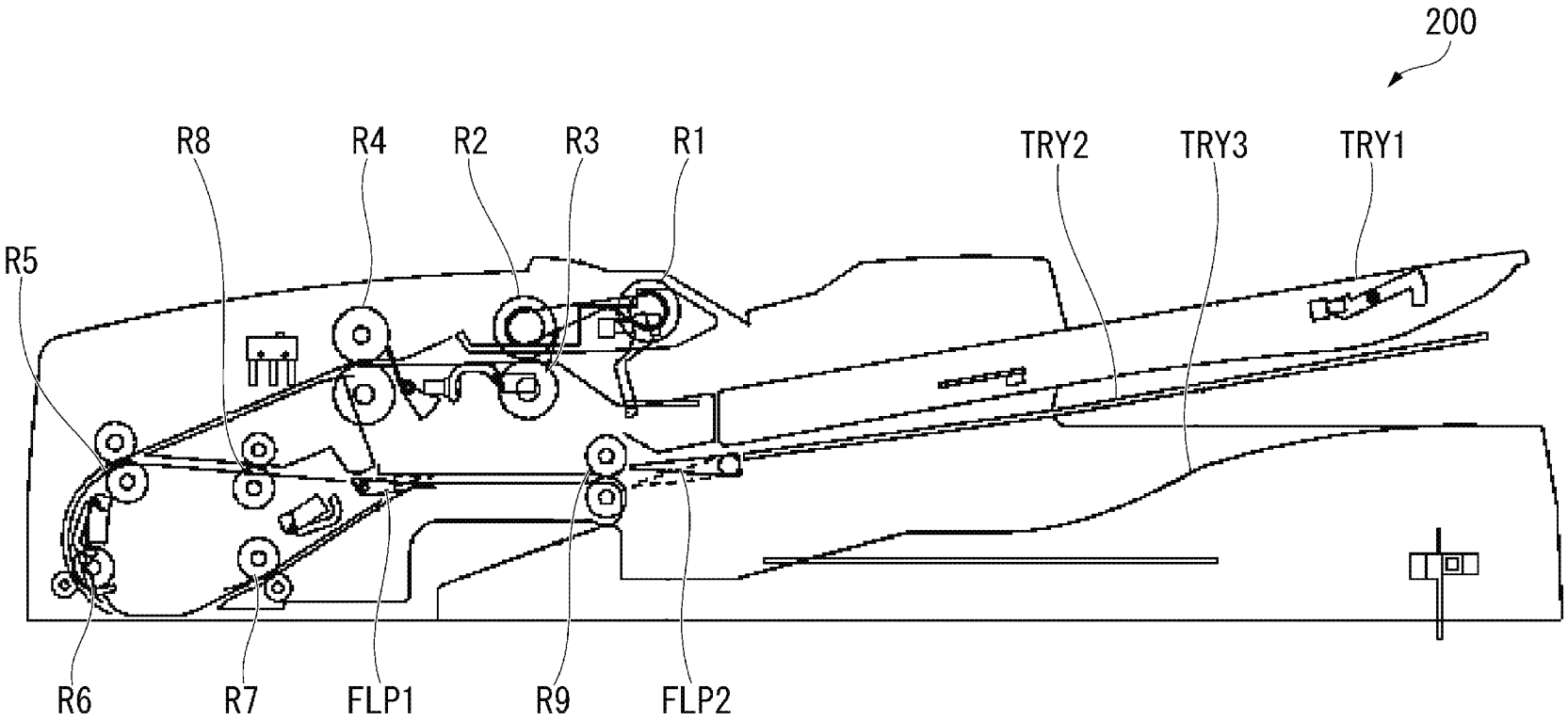
FIG. 2 is a configuration diagram showing an example of a configuration of a mechanism conveying a sheet in an image reading unit.

FIG. 2 is a configuration diagram showing an example of a configuration of a mechanism conveying a sheet in the image reading unit 200 according to the embodiment. The image reading unit 200 includes an original document tray TRY1, an original document reversing tray TRY2, an original document discharge tray TRY3, a sheet discharge gate FLP1, a reversing flapper FLP2, a pickup roller R1, a sheet feeding roller R2, a separation roller R3, a resist roller R4, an intermediate conveying roller R5, a before-reading roller R6, an after-reading roller R7, a reversing resist roller R8, and a sheet discharge and reversing roller R9.

One or a plurality of sheets to be read are placed on the original document tray TRY1. The original document reversing tray TRY2 is a member for temporarily retreating the sheet at the time of reversing the top and bottom of the sheet being conveyed. A sheet of which the reading is terminated is discharged to the original document discharge tray TRY3. The sheet discharge gate FLP1 is operated at the time of reversing the top and bottom of the sheet being conveyed. The specific details are as follows. When a sheet is conveyed in the direction of the sheet discharge and reversing roller R9, the sheet discharge gate FLP1 is pushed up by the sheet. On the other hand, if a sheet is conveyed in the direction of the reversing resist roller R4, when the sheet passes through a conveyance path below the sheet discharge gate FLP1, the sheet discharge gate FLP1 is lowered. The sheet discharge gate FLP1 is lowered to block the conveyance path in the direction of the after-reading roller R7. The sheet switched back by the sheet discharge and reversing roller R9 passes above the sheet discharge gate FLP1 and is conveyed to the conveyance path in the direction of the reversing resist roller R8.

The reversing flapper FLP2 is a member for switching a conveyance destination of the sheet being conveyed to either the original document reversing tray TRY2 or the original document discharge tray TRY3. The specific details are as follows. The reversing flapper FLP2 moves by a solenoid. When the sheet is switched back by the sheet discharge and reversing roller R9, the solenoid is turned on. Thereby, the reversing flapper FLP2 moves downward to block the conveyance path in the direction of the original document discharge tray TRY3. The sheet is conveyed in the direction of the original document reversing tray TRY2. On the other hand, when the sheet is discharged, the solenoid is turned off. Thereby, the reversing flapper FLP2 moves upward to block the conveyance path in the direction of the original document reversing tray TRY2. The sheet is conveyed in the direction of the original document discharge tray TRY3.

The pickup roller R1 rotates to convey the uppermost sheet among sheets placed on the original document tray TRY1. The sheet feeding roller R2 (feed roller 220) conveys the sheet conveyed by the pickup roller R1 in the direction of the resist roller R4.

When the conveyed sheet is a bundle of a plurality of sheets, the separation roller R3 separately sends out the sheets one by one from the sheet bundle. The separation roller R3 is attached to a shaft through a torque limiter. When the number of conveyed sheets is one or there is no sheet in a nip, the torque limiter slides. Thereby, the separation roller R3 rotates in a sheet feeding direction. On the other hand, when the number of conveyed sheets is two or more, a set torque of the torque limiter becomes higher than a frictional force between the sheets, and the separation roller R3 is stopped. Thereby, the second sheet and the subsequent sheets are prevented from being conveyed in the sheet feeding direction.

The resist roller R4 (resist roller 240) corrects an inclination of a sheet conveyed by the sheet feeding roller R2 and conveys the sheet in the direction of the intermediate conveying roller R5. The intermediate conveying roller R5 conveys the sheet conveyed by the resist roller R4 in the direction of the before-reading roller R6. The before-reading roller R6 conveys the sheet conveyed by the intermediate conveying roller R5 and conveys the sheet to the after-reading roller R7 through a reading unit of an original document. The after-reading roller R7 conveys the sheet conveyed by the before-reading roller R6 in the direction of the sheet discharge gate FLP1. The reversing resist roller R8 corrects an inclination of a reversed sheet and conveys the corrected sheet in the direction of the intermediate conveying roller R5. The sheet discharge and reversing roller R9 conveys the sheet in the direction of the reversing flapper FLP2. The sheet conveyed by the sheet discharge and reversing roller R9 is conveyed to the original document reversing tray TRY2 or the original document discharge tray TRY3 in accordance with the position of the reversing flapper FLP2.

A scanning mechanism reading an original document is disposed below the mechanism performing conveyance shown in FIG. 2. For example, an image on a sheet is read at a position between the before-reading roller R6 and the after-reading roller R7.

Figure 3:
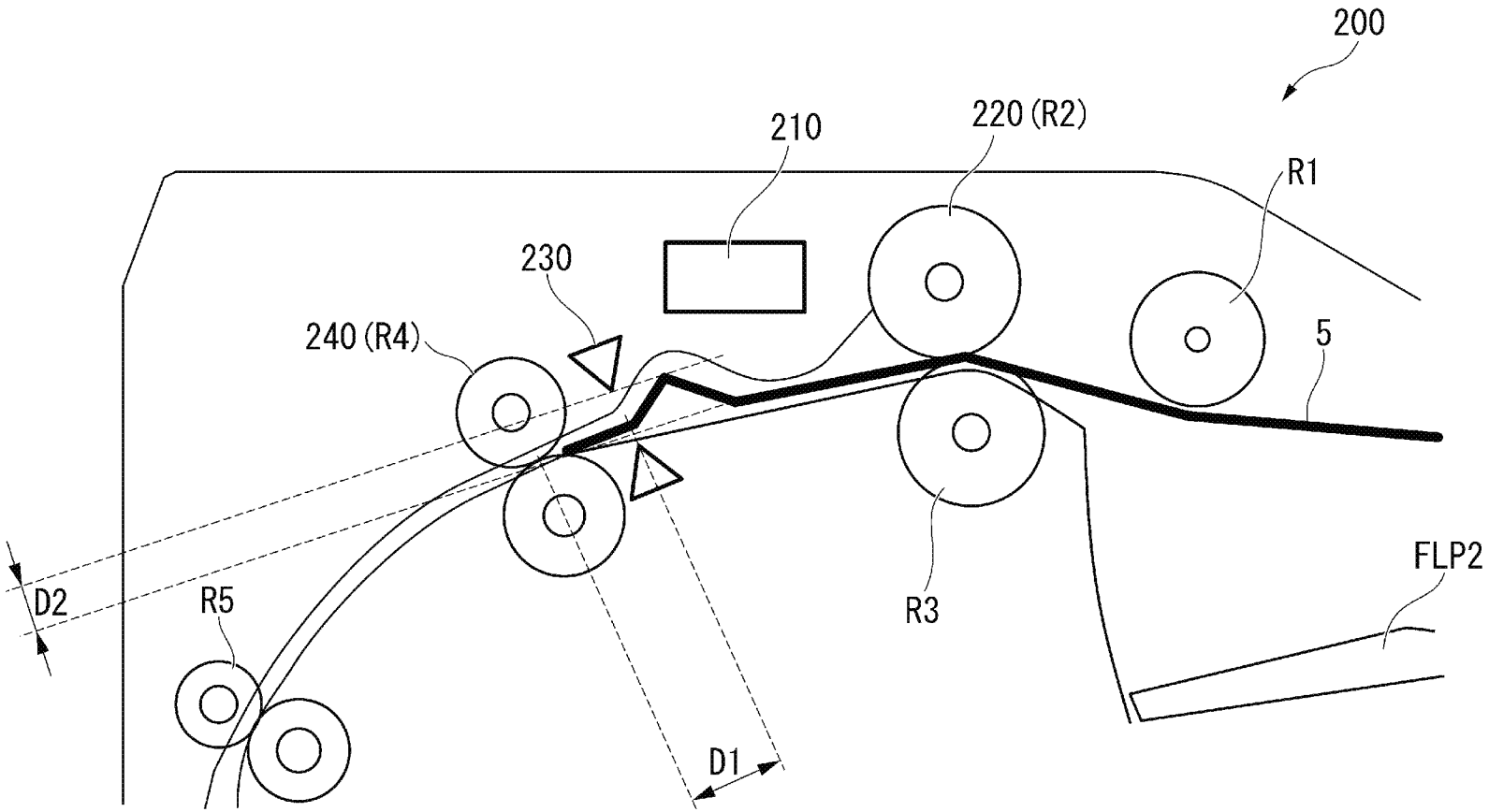
FIG. 3 is a configuration diagram showing an example of a portion of the configuration of the mechanism conveying a sheet in the image reading unit.

FIG. 3 is a configuration diagram showing an example of a portion of the configuration of the mechanism conveying a sheet in the image reading unit 200 according to the embodiment. FIG. 3 shows a feed motor 210, a feed roller 220, a resist sensor 230, and a resist roller 240. Hereinafter, components shown in FIG. 3 will be further described.

The feed motor 210 rotates the feed roller 220. The feed motor 210 is configured using a motor of which the amount of rotation can be controlled in accordance with the number of driving pulses. Further, in the feed motor 210, the value of a current is increased in accordance with an increase in a load applied to the motor under the control of a driver. The feed motor 210 is configured using, for example, a stepping motor.

The feed roller 220 rotates in accordance with the rotation of the feed motor 210 and conveys a sheet. When the sheet abuts on the resist roller 240, the feed roller 220 rotates by a predetermined number of rotations from a point in time of the abutting and then stops. The predetermined number of rotations is set in advance so that a predetermined amount of deflection is formed in the sheet.

The resist sensor 230 is a sensor which is installed upstream of the resist roller 240 and detects the presence of a sheet. The resist sensor 230 may be configured using, for example, an optical sensor.

When a sheet is present in a region where the resist sensor 230 can detect a sheet (hereinafter, referred to as "a sensing region"), the resist sensor 230 notifies the control unit 170 of an "ON" signal. When a sheet is not present in the sensing region, the resist sensor 230 notifies the control unit 170 of an "OFF" signal.

The resist roller 240 is constituted by a plurality of rollers, and the rollers are disposed so as to face to and abut on each other through a conveyance path of a sheet. In the resist roller 240, a leading end position of a sheet sent out from the feed roller 220 abuts at a contact position between the rollers. The sheet abuts on the resist roller, so that an inclination with respect to a conveyance direction is corrected. The resist roller 240 conveys the sheet having the corrected inclination to the downstream side (scanner 250) in the conveyance direction. The resist roller 240 is driven by, for example, the feed motor 210.

The scanner 250 reads an image on the sheet conveyed by the resist roller 240 to generate image data. The scanner 250 transmits the generated image data to a read data management unit 172.

In FIG. 3, a length D1 indicates a distance between the resist sensor 230 and the resist roller 240. More specifically, in the present embodiment, the length D1 is a distance between a position where an end of a sheet 5 on the downstream side in the conveyance direction is sensed by the resist sensor 230 and a position where the end is nipped by the resist rollers 240.

In FIG. 3, a height D2 indicates the height of a deflection. In the present embodiment, a deflection suppressing a variation in the height D2 is formed by the rotation of the feed roller 220.

Figure 4:
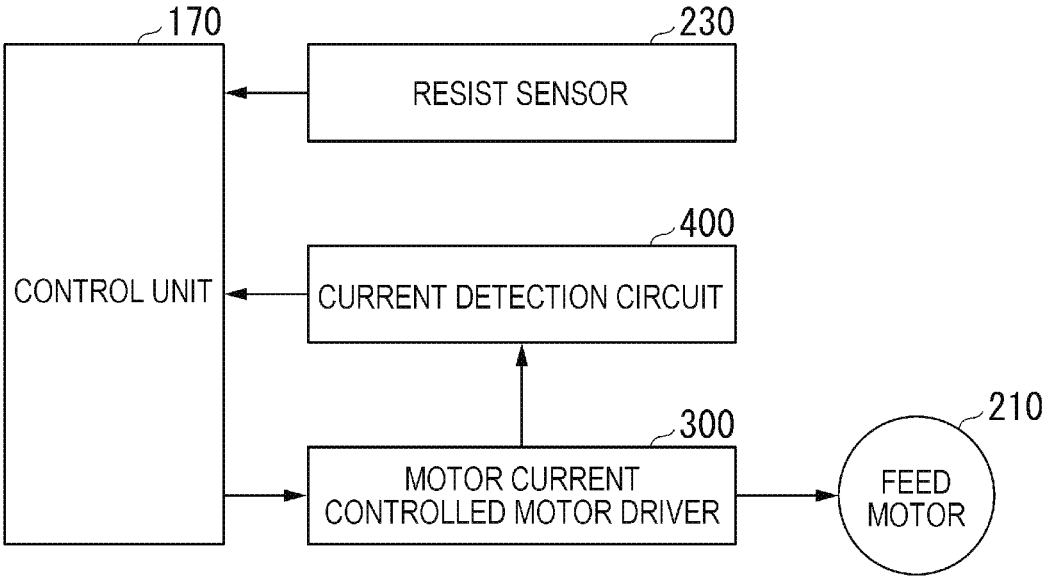
FIG. 4 is a diagram showing a specific example of a configuration related to control of a feed motor.

FIG. 4 is a diagram showing a specific example of a configuration related to control of the feed motor 210 according to the embodiment.

The control unit 170 receives an "ON" or "OFF" signal from the resist sensor 230. The control unit 170 receives a current value detected by a current detection circuit 400. The control unit 170 controls a motor current controlled motor driver 300 (hereinafter, referred to as "a driver 300") on the basis of an output and a current value of the resist sensor 230. The control unit 170 controls the driver 300 to control the rotation of the feed motor 210. As a result, the number of rotations of the feed roller rotating in accordance with the rotation of the feed motor 210 is controlled.

The driver 300 increases or decreases a current value of the feed motor 210 in accordance with a fluctuation in a load to be applied to the feed motor 210. The driver 300 is controlled by the control unit 170. For example, a current lower limit value is set in the driver 300 by the control unit 170.

The current lower limit value is a lower limit value of a current to be applied to the feed motor 210 as a motor current. When the current lower limit value is set, the driver 300 applies a current having the set current lower limit value to the feed motor 210. For example, the current lower limit value may be expressed as a ratio with respect to an upper limit value of a current flowing through the feed motor 210 (hereinafter, referred to as "a current upper limit value"). For example, the current lower limit value may be expressed as n % (n is a value equal to or greater than 0 and equal to or less than 100) of the current upper limit value.

The current detection circuit 400 detects a current value flowing through the feed motor 210. The current detection circuit 400 notifies the control unit 170 of the detected current value.

Figure 5:
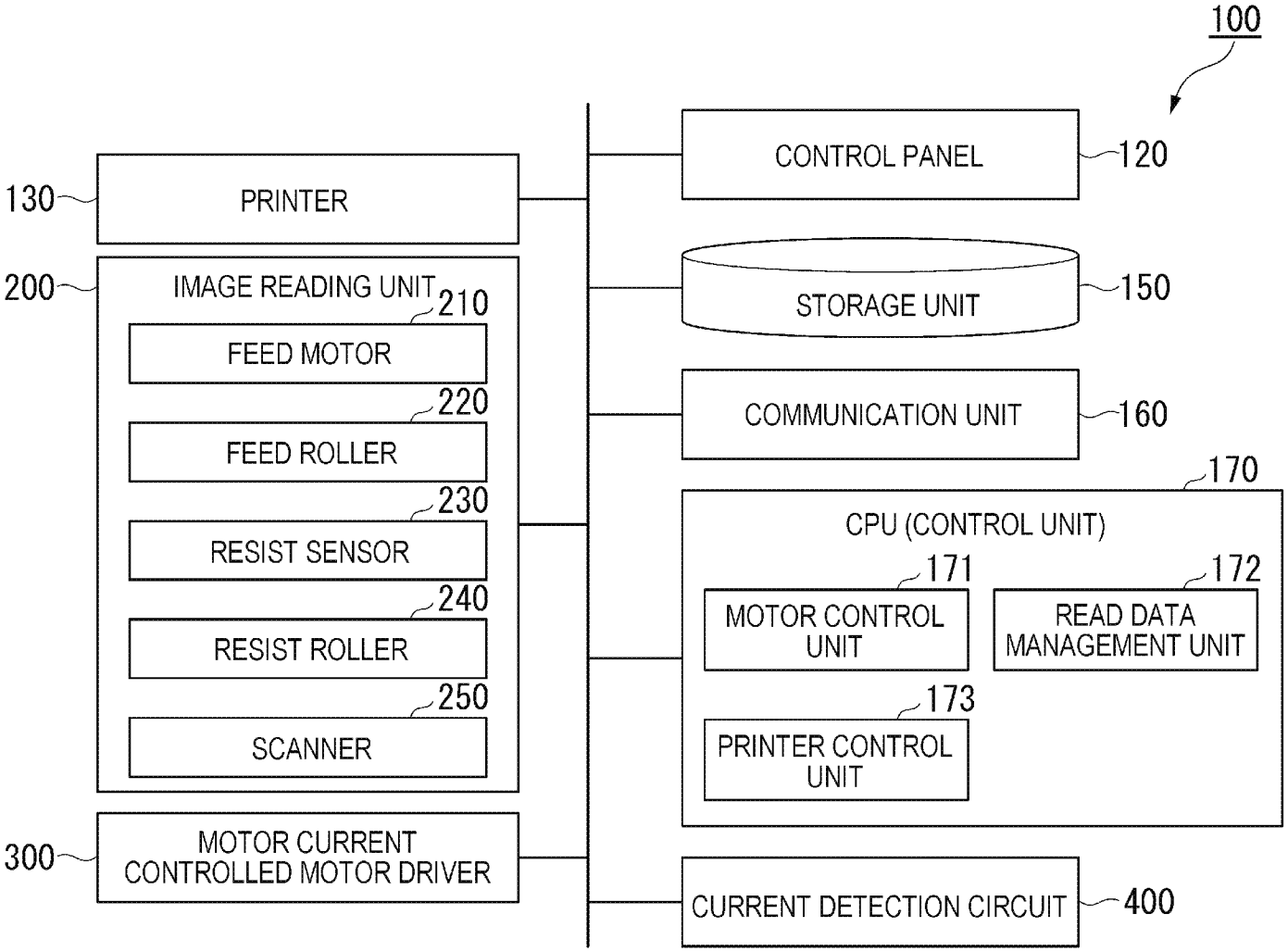
FIG. 5 is a block diagram showing functions of the image processing apparatus.

FIG. 5 is a block diagram showing functions of the image processing apparatus 100 according to the embodiment. The image processing apparatus 100 includes the control panel 120, the printer 130, a storage unit 150, a communication unit 160, the control unit 170, the driver 300, and the current detection circuit 400. Meanwhile, descriptions of the control panel 120, the printer 130, the image reading unit 200, the driver 300, and the current detection circuit 400 which are described in FIGS. 1 to 4 will be appropriately omitted.

The storage unit 150 is configured using a storage device such as a magnetic hard disk device or a semiconductor memory device. The storage unit 150 stores a current lower limit value used in a motor control unit 171. The storage unit 150 stores image data read by the scanner 250. The storage unit 150 may store information other than the above-described information.

The communication unit 160 is a communication interface. The communication unit 160 communicates with a personal computer (PC) and an information processing device such as a smart phone or a tablet through a network. The communication unit 160 may communicate with other image forming apparatuses and image processing apparatuses.

The control unit 170 is configured using a processor such as a central processing unit (CPU). The processor executes programs, so that the control unit 170 functions as the motor control unit 171, the read data management unit 172, and a printer control unit 173.

The motor control unit 171 controls the rotation of the feed motor 210 by controlling the driver 300. The rotation of the feed roller 220 is controlled by controlling the feed motor 210 under the control of the motor control unit 171.

The read data management unit 172 manages image data generated by the scanner 250. For example, the read data management unit 172 may store the image data in the storage unit 150. The read data management unit 172 may transmit, for example, generated image data to another information processing device through the communication unit 160.

The printer control unit 173 controls the printer 130. The printer control unit 173 causes the printer 130 to print, for example, image data generated by the scanner 250. The printer control unit 173 may cause the printer 130 to print image data stored in the storage unit 150.

Next, a specific example of an operation of the motor control unit 171 will be described. First, the related art of motor control will be described, and then an operation example of the motor control unit 171 according to the embodiment will be described.

Figure 6:
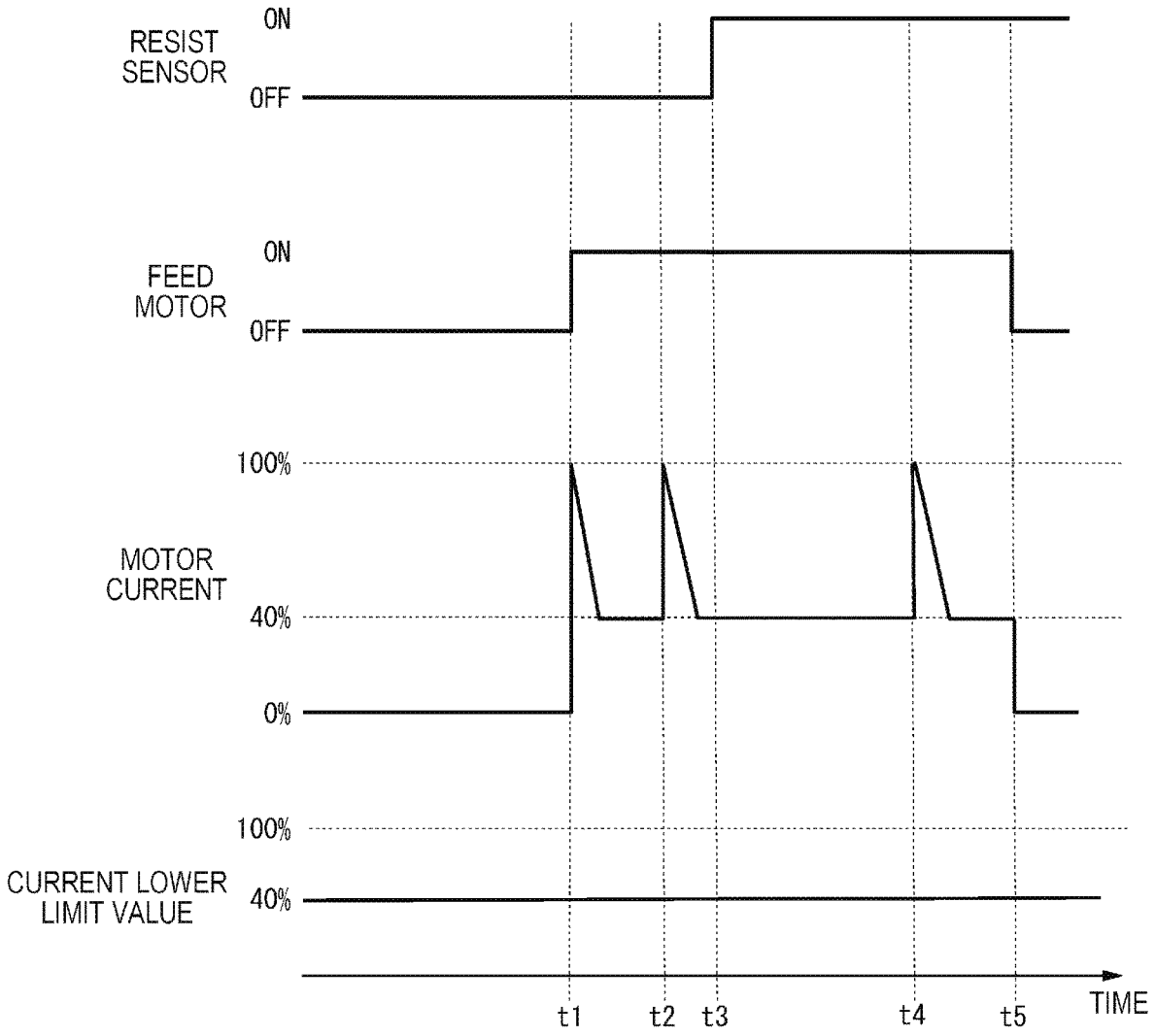
FIG. 6 is a schematic diagram showing the related art of motor control and operations when a current lower limit value is relatively low.

FIG. 6 is a schematic diagram showing the related art of motor control and operations when a current lower limit value is relatively low. In FIG. 6, the current lower limit value is fixedly set to 40%. FIG. 6 shows operation transition of the resist sensor 230, operation transition of the feed motor 210, time changes in the value of a current (motor current) flowing through the feed motor 210, and time changes in a current lower limit value.

When sheet conveyance processing is started at time t1, a current lower limit value is set to 40% of a current upper limit value, and the feed motor 210 starts to rotate. Since a large load is applied to the feed motor 210 immediately after the rotation thereof is started, a boost occurs. When the boost occurs, a motor current is set to a value close to 100% of a current upper limit value. Thereafter, the motor current is immediately set to a current lower limit value. If a load is accidentally applied to the feed motor 210 during conveyance of a sheet, a boost occurs immediately when a current lower limit value is low. For example, in FIG. 6, a boost occurs at a timing of time t2.

When the resist sensor 230 detects a sheet at time t3, a feed roller according to the related art rotates by a predetermined number of rotations thereafter. Thereafter, when the leading end of the sheet abuts on the resist roller 240 at a timing of time t4, the leading end of the sheet does not move forward any more. For this reason, a larger load is applied to the feed motor 210 rotating to further convey the sheet than before the leading end of the sheet abuts on the resist roller 240. A boost occurs in the feed motor 210 in accordance with the load. Thereafter, the amount of rotation equivalent to a predetermined number of rotations is terminated at a timing of time t5. At this timing, the rotation of the feed motor is terminated.

In the related art configured in this manner, a current lower limit value is fixedly set to a low value (40% of a current upper limit value). For this reason, a boost occurs due to a load accidentally generated at time t2. That is, a boost also occurs at timings other than a timing when the sheet abuts on the resist roller 240. For this reason, it is difficult to determine the timing when the sheet abuts on the resist roller 240 with a high level of accuracy on the basis of the boost.

Figure 7:
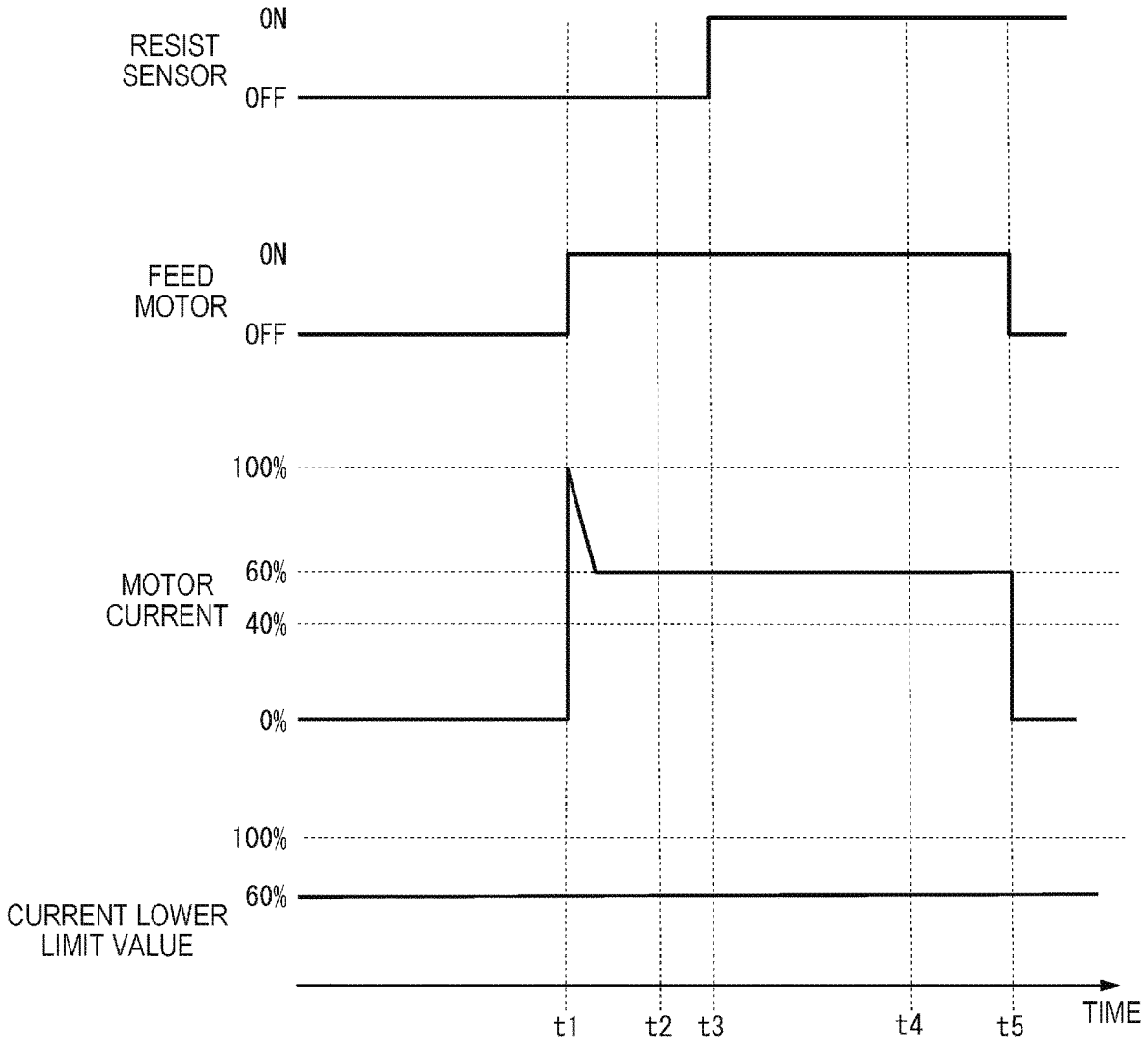
FIG. 7 is a schematic diagram showing the related art of motor control and operations when a current lower limit value is relatively high.

FIG. 7 is a schematic diagram showing the related art of motor control and operations when a current lower limit value is relatively high. In FIG. 7, the current lower limit value is fixedly set to 60%. FIG. 7 shows operation transition of the resist sensor 230, operation transition of the feed motor 210, time changes in the value of a current (motor current) flowing through the feed motor 210, and time changes in a current lower limit value.

When sheet conveyance processing is started at time t1, a current lower limit value is set to 60% of a current upper limit value, and the feed motor 210 starts to rotate. Since a large load is applied to the feed motor 210 immediately after the rotation thereof is started, a boost occurs. When the boost occurs, a motor current is set to a value close to 100% of a current upper limit value. Thereafter, the motor current is immediately set to a current lower limit value. Even if a load is accidentally applied to the feed motor 210 during conveyance of a sheet, a boost does not occur when a current lower limit value is low. For example, in FIG. 7, a boost does not occur even at a timing of time t2.

When the resist sensor 230 detects a sheet at time t3, a feed roller according to the related art rotates by a predetermined number of rotations thereafter. Thereafter, when the leading end of the sheet abuts on the resist roller 240 at a timing of time t4, the leading end of the sheet does not move forward any more. For this reason, a larger load is applied to the feed motor 210 rotating to further convey the sheet than before the leading end of the sheet abuts on the resist roller 240. However, a boost does not occur in the feed motor 210 even by this load. Thereafter, the amount of rotation equivalent to a predetermined number of rotations is terminated at a timing of time t5. At this timing, the rotation of the feed motor is terminated.

In the related art configured in this manner, a current lower limit value is fixedly set to a high value (60% of a current upper limit value). For this reason, a boost does not occur due to a load accidentally generated at time t2. However, a boost does not occur even at a timing when the sheet abuts on the resist roller 240. For this reason, it is difficult to determine the timing when the sheet abuts on the resist roller 240 with a high level of accuracy on the basis of the boost.

Figure 8:
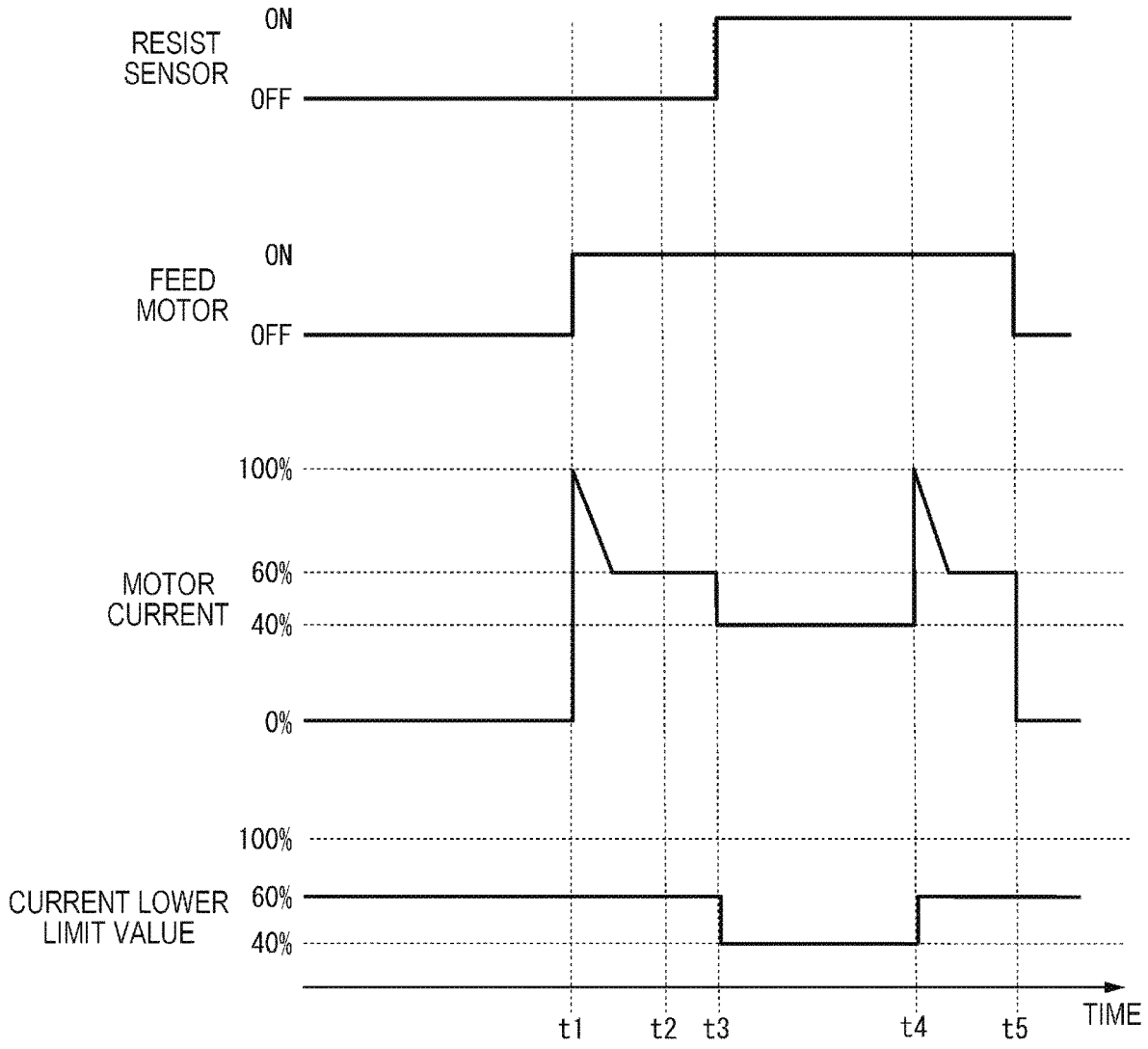
FIG. 8 is a schematic diagram showing a control operation performed by a motor control unit.

FIG. 8 is a schematic diagram showing a control operation performed by the motor control unit 171 according to the present embodiment. In FIG. 8, a current lower limit value is dynamically set to either a relatively high first current lower limit value (60% of a current upper limit value) or a relatively low second current lower limit value (40% of a current upper limit value). FIG. 8 shows operation transition of the resist sensor 230, operation transition of the feed motor 210, time changes in the value of a current (motor current) flowing through the feed motor 210, and time changes in a current lower limit value. The first current lower limit value may be a value that does not cause a boost when the sheet abuts on the resist roller 240. The second current lower limit value may be a value that causes a boost when the sheet abuts on the resist roller 240.

When sheet conveyance processing is started at time t1, the motor control unit 171 sets a current lower limit value to the first current lower limit value and starts to rotate the feed motor 210. Since a large load is applied to the feed motor 210 immediately after the rotation thereof is started, a boost occurs. When the boost occurs, a motor current is set to a value close to 100% of a current upper limit value. Thereafter, the motor current is immediately set to a current lower limit value (first current lower limit value). Even when a load is accidentally applied to the feed motor 210 during conveyance of a sheet, a boost does not occur because the current lower limit value is high. For example, in FIG. 8, a boost does not occur even at a timing of time t2.

When the resist sensor 230 detects a sheet at time t3, the motor control unit 171 sets a current lower limit value to the second current lower limit value. Thereafter, when the leading end of the sheet abuts on the resist roller 240 at a timing of time t4, the leading end of the sheet does not move forward any more. For this reason, a larger load is applied to the feed motor 210 rotating to further convey the sheet than before the leading end of the sheet abuts on the resist roller 240. At this point in time, a current lower limit value is set to the second current lower limit value which is a relatively low value. For this reason, a boost occurs in the feed motor 210 in accordance with the load. The motor control unit 171 determines occurrence of a boost on the basis of a predetermined threshold value. The predetermined threshold value may be a threshold value provided for the value of a motor current or may be a threshold value provided for the amount of increase in the motor current. The motor control unit 171 rotates the feed motor 210 by a predetermined number of rotations from the timing when the boost occurs. Thereafter, when the amount of rotation equivalent to a predetermined number of rotations is terminated at a timing of time t5, the motor control unit 171 stops rotating the feed motor 210.

The predetermined number of rotations may be set for each type of sheet. For example, the predetermined number of rotations may be set to a larger value as a sheet has a lower friction coefficient of the surface thereof. For example, the predetermined number of rotations may be set to a larger value as a sheet has a larger thickness. The first current lower limit value and the second current lower limit value may be set for each type of sheet. For example, a relatively higher value may be set as the first current lower limit value and the second current lower limit value as a sheet has a lower friction coefficient of the surface thereof. For example, a relatively higher value may be set as the first current lower limit value and the second current lower limit value as a sheet has a larger thickness.

In the present embodiment configured in this manner, a current lower limit value is dynamically changed. A current lower limit value is set to the first current lower limit value from when the feed roller 220 starts to rotate until a sheet is detected by the resist sensor 230. For this reason, a boost caused by a load generated accidentally is unlikely to occur in the meantime. On the other hand, a current lower limit value is set to the second current lower limit value after a sheet is detected by the resist sensor 230. For this reason, a boost occurs at a timing when the sheet abuts on the resist roller 240. For this reason, it is possible to determine the timing when the sheet abuts on the resist roller 240 with a high level of accuracy on the basis of the boost.

When it is detected that the sheet abuts on the resist roller 240, the motor control unit 171 rotates the feed motor 210 by a predetermined number of rotations from the timing. The feed roller 220 also rotates by a predetermined number of rotations in accordance with the rotation. The predetermined number of rotations is set so that a deflection having a magnitude determined in advance is formed. With such a configuration, it is possible to reduce variations in the magnitude of a deflection of a sheet. Hereinafter, such an effect will be described in detail.

In both the related art and the present embodiment, a feed motor is rotated by a predetermined number of rotations from a timing determined in each of the related art and the present embodiment. By this rotation, a deflection is formed aiming at a predetermined magnitude. In the related art, a feed motor is rotated by a predetermined number of rotations from a timing (time t3) when the resist sensor 230 detects a sheet. On the other hand, in the present embodiment, a feed motor is rotated by a predetermined number of rotations from a timing (time t4) when it is detected that the leading end of a sheet abuts on the resist roller 240. In this manner, in the present embodiment, the amount of rotation equivalent to a predetermined number of rotations is started from a later timing than in the related art. That is, in the present embodiment, a distance at which a sheet is conveyed by the amount of rotation equivalent to a predetermined number of rotations is shorter than that in the related art. Therefore, an error of the distance at which the sheet is conveyed by the amount of rotation equivalent to a predetermined number of rotations is reduced. As a result, it is possible to reduce variations in the magnitude of a deflection of the sheet. Particularly, in the present embodiment, the feed motor 210 is rotated by a predetermined number of rotations after it is detected that the leading end of the sheet abuts on the resist roller 240. For this reason, it is possible to avoid a state where the leading end of the sheet does not abut on the resist roller 240 at all with a higher probability.

Modification Example

The sheet conveying device according to the present embodiment may be used not for an ADF but for a sheet conveying mechanism at the time of sheet feeding.

Figure 9:
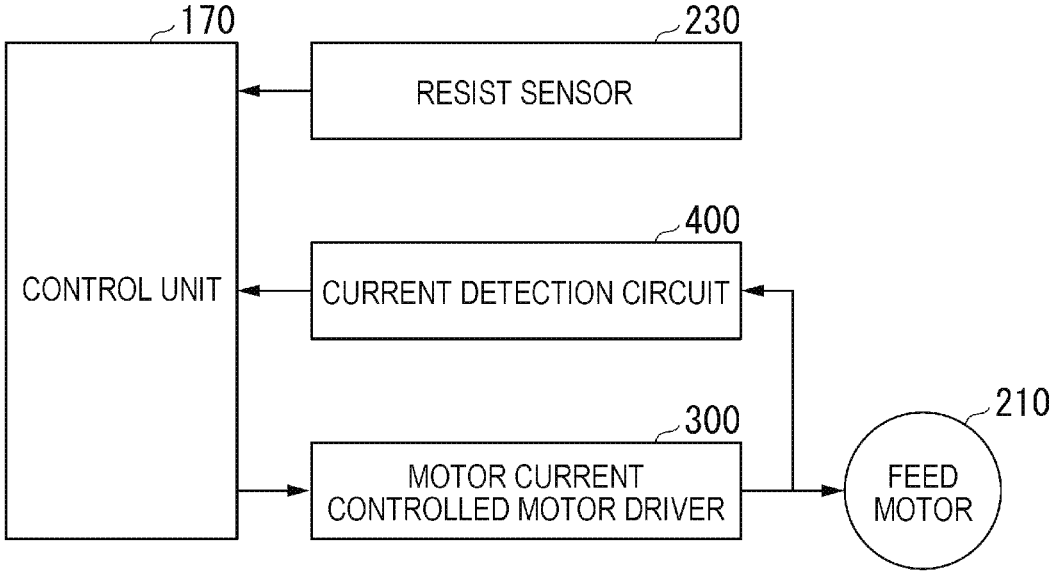
FIG. 9 is a diagram showing a specific example of a configuration related to control of a feed motor according to a modification example.

FIG. 9 is a diagram showing a specific example of a configuration related to control of the feed motor 210 according to a modification example. Meanwhile, the same description as the description in FIG. 4 will be omitted. The current detection circuit 400 in the modification example detects an actual current value flowing through the feed motor 210 by the driver 300. The current detection circuit 400 notifies the control unit 170 of the detected current value.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet conveying device comprising:

a conveying roller that conveys a sheet;

a motor that rotates the conveying roller;

a resist roller that corrects an inclination of the sheet conveyed by the conveying roller;

a sensor positioned upstream of the resist roller that detects the sheet; and a motor control unit that determines whether the sheet abuts the resist roller after the sheet is detected by the sensor, and drives the motor by a predetermined number of rotations when the sheet abuts the resist roller, wherein the motor control unit drives the motor with a first current lower limit value until the sensor detects the sheet and drives the motor with a second current lower limit value lower than the first current lower limit value after the sensor detects the sheet.

2. The device according to claim 1, wherein the second current lower limit value is a value causing a boost in a current of the motor when the sheet abuts the resist roller.

3. The device according to claim 1, wherein the first current lower limit value is a value not causing a boost in a current of the motor when the sheet abuts the resist roller.

4. The device according to claim 1, wherein the motor control unit determines whether the sheet abuts the resist roller on the basis of an amount of increase in a current value of the motor.

5. The device according to claim 2, wherein the motor control unit determines whether the sheet abuts the resist roller when a current value of the motor or an amount of increase in the current value exceeds a predetermined threshold value.

6. The device according to claim 1, wherein the motor control unit drives the motor by the number of rotations according to a type of sheet.

7. An image processing apparatus comprising:

the sheet conveying device according to claim 1; and a scanner that reads an image on the sheet conveyed by the sheet conveying device.

8. An image forming apparatus comprising:

the sheet conveying device according to claim 1; and a printer that forms an image on the sheet conveyed by the sheet conveying device.

9. A sheet conveying method performed by a sheet conveying device including a conveying roller that conveys a sheet, a motor that drives the conveying roller, a resist roller that corrects an inclination of the sheet conveyed by the conveying roller, a sensor positioned upstream of the resist roller and detects the sheet, and a motor control unit that controls the motor, the method comprising:

causing the motor control unit to determine whether the sheet abuts the resist roller after the sheet is detected by the sensor; and causing the motor control unit to drive the motor by a predetermined number of rotations when the sheet abuts the resist roller, wherein driving the motor with a first current lower limit value until the sensor detects the sheet and drives the motor with a second current lower limit value lower than the first current lower limit value after the sensor detects the sheet.

10. The method according to claim 9, wherein the second current lower limit value is a value causing a boost in a current of the motor when the sheet abuts the resist roller.

11. The method according to claim 9, wherein the first current lower limit value is a value not causing a boost in a current of the motor when the sheet abuts the resist roller.

12. The method according to claim 9, further comprising:

determining whether the sheet abuts the resist roller on the basis of an amount of increase in a current value of the motor.

13. The method according to claim 10, further comprising:

determining whether the sheet abuts the resist roller when a current value of the motor or an amount of increase in the current value exceeds a predetermined threshold value.

14. The method according to claim 9, further comprising:

driving the motor by the number of rotations according to a type of sheet.

15. The method according to claim 9, further comprising:

scan reading an image on the sheet conveyed by the sheet conveying device.

16. The method according to claim 9, further comprising:

forming an image on the sheet conveyed by the sheet conveying device.

17. The method according to claim 9, further comprising:

driving the resist roller with the motor.

18. The method according to claim 9, wherein the predetermined number of rotations is set according to a type of sheet.

* * * * *